US006738986B1

(12) United States Patent
Martin

(10) Patent No.: US 6,738,986 B1
(45) Date of Patent: May 25, 2004

(54) HEAD COVERING

(76) Inventor: Susan G. Martin, 307 W. Tremont Ave. Studio C, Charlotte, NC (US) 28203

( * ) Notice: Subject to any disclaimer, the term of this patent is extended or adjusted under 35 U.S.C. 154(b) by 18 days.

(21) Appl. No.: 10/155,268

(22) Filed: May 24, 2002

Related U.S. Application Data

(60) Provisional application No. 60/293,281, filed on May 24, 2001.

(51) Int. Cl.[7] ..... A42B 5/00
(52) U.S. Cl. ..... 2/207; 2/171
(58) Field of Search ..... 2/171, 172, 175.1, 2/174, 181, 195.1, 195.7, 195.8, 202, 203, 207, 204, DIG. 11; D2/865, 881; 132/245

(56) References Cited

U.S. PATENT DOCUMENTS 3,377,628 A * 4/1968 Le Sante ..... 2/207
3,391,405 A 7/1968 Wisell, Jr.
4,017,926 A 4/1977 Piel
4,227,262 A 10/1980 Insulan et al.
4,491,985 A * 1/1985 Dalton ..... 2/172
5,048,128 A * 9/1991 Watson, Jr. ..... 2/204
5,062,157 A * 11/1991 Mta ..... 2/171
5,081,717 A * 1/1992 Shedd et al. ..... 2/181.4
5,157,788 A * 10/1992 Schultz ..... 2/7
D359,384 S * 6/1995 Dlugokeski ..... D2/880
5,544,364 A * 8/1996 Weber ..... 2/104
5,594,956 A * 1/1997 Barrientos ..... 2/207
5,622,762 A 4/1997 Perla
5,860,165 A * 1/1999 Cvijanovich ..... 2/195.1
5,878,756 A * 3/1999 Bilodeau ..... 2/172
5,915,534 A * 6/1999 May ..... 2/181.4
5,950,241 A * 9/1999 Gomez ..... 2/172
5,965,223 A * 10/1999 Andrews et al. ..... 428/34.5
6,047,706 A * 4/2000 Skiba et al. ..... 2/174
6,481,021 B2 * 11/2002 Spell ..... 2/209.13
6,493,880 B1 * 12/2002 Lo ..... 2/195.2
6,560,784 B2 * 5/2003 Hill ..... 2/171

* cited by examiner

*Primary Examiner*—Gary L. Welch
(74) *Attorney, Agent, or Firm*—Dougherty, Clements & Hofer

(57) ABSTRACT

The invention is a head covering that is particularly suited for use when participating in aquatic sports activities, such as scuba diving, snorkeling, sailing, and jet skiing, where the fabric is selected for its quick drying ability and stretchability, therein enabling excellent conformability to the body. Well known fabric brand names include Spandex, Lycra, and nylon or blends thereof. The head covering helps retain body heat, protect against sunburn, keep hair pulled away from a diver's mask, restrains hair in the back of the head, and makes divers on the surface more visible to boat crew. The head covering has a compartment/pouch which can optionally be disguised as to substantially form a hidden pocket. The fabric of the head covering is preferably brightly colored, stylish and decorative, and may be associated with a designer.

26 Claims, 5 Drawing Sheets

Fig.6
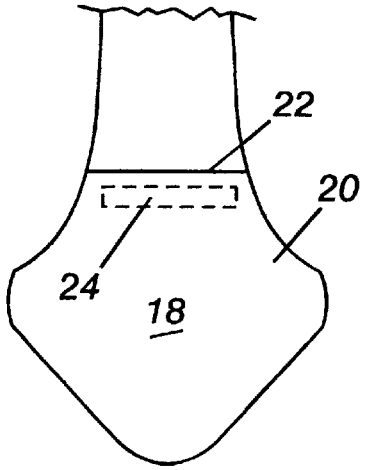
Fig.7
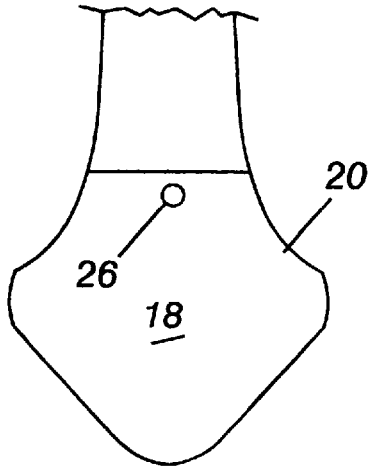
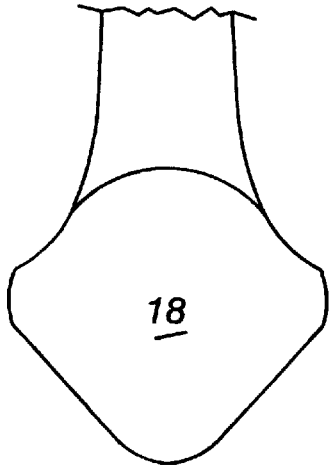
Fig.8
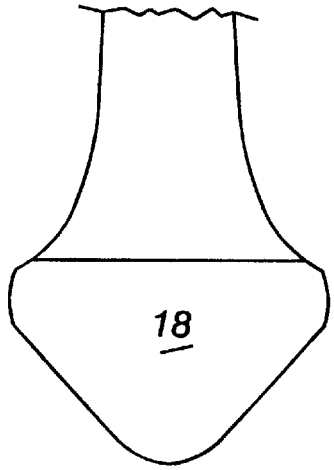
Fig.9

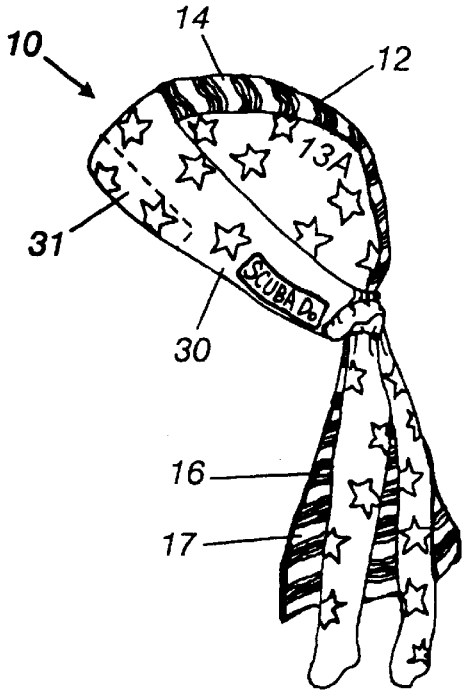
Fig.10
Fig.11
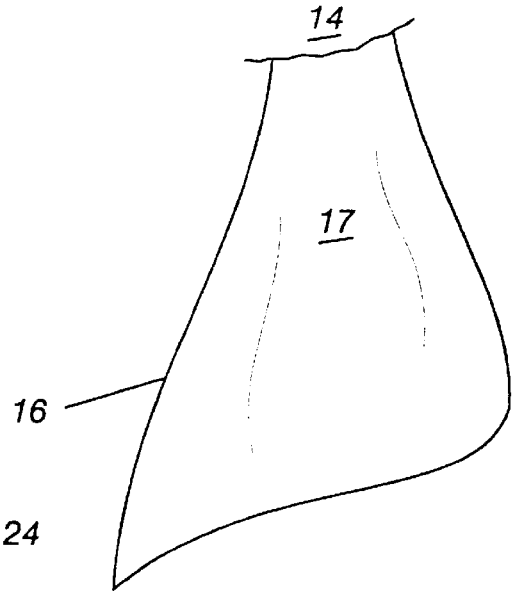
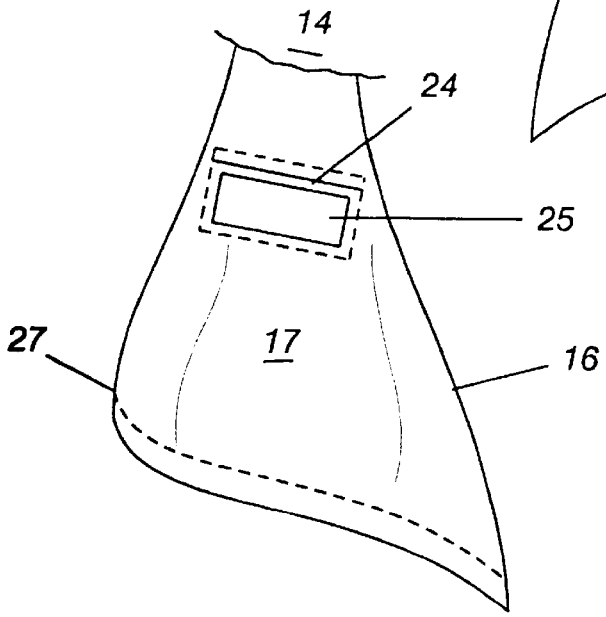
Fig.12

HEAD COVERING

CROSS REFERENCE TO RELATED APPLICATION

This application claims the benefit of U.S. Provisional Application No. 60/293281, filed May 24, 2001.

FIELD OF THE INVENTION

The present invention relates to an article of manufacture for use as a head covering, which is particularly useful for scuba diving, and other athletic activities.

BACKGROUND OF THE INVENTION

Divers, particularly scuba divers, have a need for protecting the head from impact with underwater hazards such as coral or debris while diving, as well as needing protection from the sun while on the surface of the water. Largely for safety reasons, divers dive in groups, and underwater and surface identification and visibility is advantageous to see and identify the individual members of the party both from the boat and underwater. Conventional diving hoods prevents loss of body heat from the users head, but make diver identification and visibility difficult. Also, hoods are usually constrictive and uncomfortable for divers, notably scuba and free form divers. They are usually constructed of an elastic material such as Neoprene®, which is a closed cell foam material containing air pockets, Nylon®, and more recently Lycra®. FIG. 1 and FIG. 2 depict prior art hoods and swimmer caps, respectively. Hoods and swimmer caps, as shown in the figures cover not only the head, but also cover underneath the chin and around the neck of the user. As seen in the prior art, hoods and swimmer caps are in part constrictive because they are largely unadjustable by the user. The hoods and the swimmer's caps are fabricated in standard head sizes, and rely almost completely on the stretchability of the material to produce a conforming fit. Swimming caps and headbands are also used to keep hair out of the user's face.

The patent literature addresses some of the problems associated with the current art. Perla, U.S. Pat. No. 5,622,762, addresses the problem of using Neoprene. Neoprene creates air pockets as the Neoprene creases at the folds and tends to retain the creases. Another disadvantage of Neoprene is that the cells seem to collapse at the higher pressures encountered at greater depths. Perla'762 describes a material comprised of an outer layer, Lycra, bonded to a first layer of a plush type material which is then bonded to second inner layer of a denser plush type material. The bond between the Lycra and the first inner plush layer is preferably formed by coating the facing surfaces with a solid film of a water resistant contact cement. Perla's invention results in a four layer laminate, wherein the layers are adhesively attached through contact cement. While the Lycra is elastic, Perla's invention does not address the issue of the elasticity of the contact cement, the net effect being what one might expect with a laminate, a relatively stiff material is formed despite the use of some elastic materials.

Insulan, U.S. Pat. No. 4,227,262, discloses a protective suit with an insulated head piece. Insulan's invention is essentially a dry suit. Insulan'262 describes head gear which is worn between the inner hood and the outer hood of the dry suit. As shown in the prior art figures, Insulan's invention also would be very constricting for the diver. The head gear is formed of a tricoat of material which is elastic and flexible (in all directions), and the named elastic coating is rubber.

Piel in U.S. Pat. No. 4,017,926 describes a life saving garment for a person in water. Piel'926 is included merely to be illustrative of a wet suit that is in fact quite constricting.

Wiswell, U.S. Pat. No. 3,391,405, discloses a diving suit, of the wet suit type, for keeping the user warm by the circulation of warm water through tubes mounted in the suit and a zipper arrangement to facilitate putting on or taking off the suit. Wiswell's diving suit is typical of wet suits and particularly of hoods in that the conventional closure mechanism is a zipper. A zipper does not allow any adjustment as to size, and the fit is totally dependent upon the suit/hood material stretching sufficiently so as to snug the hood against the skin, yet not be so tight as to cut off circulation. A zipper also has the characteristic that it has many intermeshing components, all of which must fit together for the zipper to function properly. Divers frequently encounter problems with zippers. Zippers become stiff or very difficult to open/close, as sand and salt and oxidation corrode the zipper.

What is needed is an improved head covering for use while participating in athletic activities, and particularly aquatic sports, where the material does not crimp; the head covering readily conforms to the shape of the head and is easily adjustable; and where the means of adjustment is not easily fouled, as is the case with a zipper. Also advantageous would be a head covering that facilitates the carrying of small items (preferably with the capability of keeping the items dry such as a whistle, watch, money, etc); and a head covering that lends itself to having more attractive lines than the prior art. There is a truism about boats that applies to aquatic head coverings. It is known that boats that look fast are fast, and a head covering that looks good has improved performance. A head covering having improved style is desired. Additionally desired is a head covering that provides easy identification and visibility, a head covering that will not entangle hair like a zipper, and a head covering that lends itself to being fabricated such that the head covering is quick drying and can be either thermally insulating or thermally cooling. The head covering should be resistant to bacterial and fungal growth.

SUMMARY OF THE INVENTION

The present invention provides a head covering for covering a diver's hair and scalp and protecting a diver's head while diving by providing a unique fabric head covering, preferably made of spandex or another stretchable fabric or blend of fabrics which is quick drying. Well known trade names include Lycra A® by Dupont, Spanflex Dry® by SGCA which is 88% nylon and 12% spandex and Spanflex bipoly which is 88% polypropylene and 12% spandex. The selection of the choice of fabric is dependent on the intended function, that is to provide thermal insulation, thermal cooling, improved safety visibility and identification, quick drying, protection from the sun and a nonconstricting fit. The fabric preferably has a sun protection factor (SPF) of 40 or higher. The fabric can be selected to have lower frictional resistance in water, such as Modetec II® by Yamamoto, which has a super composite skin, and reputedly enables a diver to swim faster. The fabric preferably has antimicrobial properties, such as Imbue®, which is a trade name for a KoSa yarn having durable antifungal and antibacterial properties.

The invention has an improved size adjusting means, where the adjusting means is simple, not easily fouled, virtually unaffected by aquatic elements, and relatively easy to manufacture. Additionally the invention, in the eyes of many, is stylish in its lines, and the invention complements traditional swim wear. The adjusting means and stretchable fabric allow the head covering to be worn either above or over the wearer's ears.

The invention has improved conformability to the user's head, and is not given to crimping or creasing. It is anticipated that in addition to preventing the formation of cavities which can act as thermal anisotropic zones, the excellent conformability makes the invention suitable for applications where containment of hair is of principal concern. Examples include institutional food preparers, hospital workers, clean rooms (e.g. electronics and manufacture of film), work around machines which entangle hair, and in hair salons.

The invention also includes an integral tail compartment in a rear tail portion for storing small items or containing the wearer's hair, and the rear tail portion can be sized to provide protection from the sun. Optionally, the head covering can be adapted with side compartments, wherein when the head covering is pulled down over the wearer's ears, the side compartments are adjacent to the ears. Optionally, communication devices, head phones and extra padding can be added to the side compartments.

The invention, optionally, can include a moisture absorbent inner band in the head covering, for applications where it is anticipated that the head covering will be worn outside of the water, and it is desired to keep the user's brow dry of perspiration, or as a means of supplying a cooling source of water by wetting the inner band. The moisture absorbent inner band, or some or all of the head covering, is constructed of fabrics that wick away moisture. Commonly known trade names of fabrics that wick away water are CoolMax® by Dupont, Dryfit® by Nike, and Gore-Tex® by WL Gore.

In applications where even more thermal regulation is required, a suitable stretchable fabric is a cloth incorporating therein Thermasorb® (which is usually sold as foam called ComforTemp®) by Frisby, where Thermasorb is an additive having regulating benefits for both insulating and cooling. Applications include where the diver is transitioning from relatively cool water such as in cave diving, to a hot dry environment.

The invented head covering is also suitable for a large number of non-diving applications such as a head cover for firemen, construction workers, policemen, and military personnel, and also for participants in sports such as tennis, football, hiking,jogging, biking, and soccer, and particularly where the temperature of the environment can change rapidly. In applications such as a head cover for firemen, a fabric incorporating a fire retardant is preferred. Also potential benefactors of the invention are people who are sick, and especially those undergoing chemotherapy treatment for cancer. The individuals are commonly very sensitive to temperature changes, and the head covering can be used to regulate their temperature.

The head covering has a central portion which covers the head of a wearer. The central portion can be made thicker so as to provide cushioning. In addition to providing extra protection for the diver, the cushioning is adaptive to those persons who wear helmets and hard hats, such as cyclists, construction workers, welders, firemen and military personnel. In these applications the head covering is preferably fabricated using flat stitching, to prevent the threads of a seam from digging into the wearer's skin.

The central portion of the invented head covering has a perimeter edge and a tail portion which extends beyond the perimeter edge. There is an edge band that is substantially coextensive and engaging with the perimeter edge of the central portion, but not the tail portion. The edge band has a left band end and a right band end, where the left band end and the right band end have sufficient length extending beyond the central portion to allow tying of the band ends for retaining the head covering on a user's head. The band ends are also of sufficient length that a knot formed by the tied ends can be used to hold the wearer's hair.

The tail portion of the head covering is provided with a compartment or pocket therein, and the compartment has an opening and a closure. The closure is any convenient means, but preferably Velcro®, zipper, snap(s), or button(s). Alternatively, the compartment can be used to tuck in the wearer's hair, thereby preventing the hair from moving around while under water.

The head covering preferably is made from a brightly colored fabric, whereby the user can be readily seen and identified at substantial distance. Of course, under conditions where bright colors are not desired the head covering can be selected to match the need. For instance, camouflage, brown or black may be desired in some occupational applications.

OBJECTS OF THE INVENTION

The principal object of the present invention is to provide a head covering for athletic activities, particularly scuba diving, Another object of the invention is to provide a head covering which is stretchable, quick drying and is readily retained on a user's head.

Another object of the invention is to provide a head covering having a level of retainment that is sufficient such that the head covering will not be dislodged either by water when diving into water, or by wind.

Another object of the invention is to provide a head covering having a compartment therein for storing small items or restraining the wearer's hair.

Another object of the invention is to provide means for protecting a diver's head from direct contact with coral or debris by providing head covering having adequate cushioning incorporated therein.

Another object is to provide as head covering which will protect the wearer from the sun, where the fabric has an SPF of 40 or higher.

Another object is to provide a head covering that is easily adjustable, not given to fouling, and enables the wearer a means of adjusting the level of tension in the stretchable fabric to one that is comfortable.

Another object is to provide a head covering which can be fitted to optionally cover or not cover the wearer's ears.

Another object is to provide a means for the wearer to optionally elect to attach an inner band to prevent perspiration from dripping into the wearers eyes, and/or to pre-wet the inner band with cool water to help keep the wearer cooler.

Another object is to provide a head covering selected of a fabric or blend of fabrics, which provides thermal insulation, or thermal cooling, or thermal regulation.

BRIEF DESCRIPTION OF THE DRAWINGS

The foregoing and other objects will become more readily apparent by referring to the following detailed description and the appended drawings in which:

FIG. 6 is a bottom sectional view showing the underside of the tail portion of the invented head covering shown in FIG. 3.

FIG. 7 is a bottom sectional view showing an alternative underside of the tail portion of the invented head covering shown in FIG. 3.

FIG. 8 is a bottom sectional view showing another alternative underside of the tail portion of the invented head covering, where the pouch is particularly suitable for restraining loosely gathered or braided hair.

FIG. 9 is a bottom sectional view showing of still another alternative underside of the tail portion of the invented head covering, where the pouch is particularly suitable for restraining more tightly braided hair, such as a pony tail.

FIG. 10 is a perspective view of the invention as shown from the side. The central portion terminates in a tail portion having a substantially straight curtain shape for enhanced neck protection from the sun, and the head covering has a band with an inner band that is moisture absorbent.

FIG. 11 is a rear view of the substantially trapezoidal flap shaped tail portion.

FIG. 12 is an underside view of the substantially trapezoid flap shaped tail portion shown in FIG. 11, wherein there is a pouch.

DETAILED DESCRIPTION

The invention is a head covering that is particularly suited for use when participating in aquatic sports activities, such as scuba diving, snorkeling, sailing, and jet skiing, where the fabric is selected for its quick drying ability and stretchability, therein enabling excellent conformity to the body. Well known fabric brand names include Spandex, Lycra, Metalite-C®, Modetech II®, Spanflex®, Cool Max®, ComforTemp®, Imbue® and nylon and blends thereof. Additionally the fabric can have uniquely high thermal insulating characteristics such as Metalite-C® which is a SheiCo Group stretchable fabric comprised substantially of nylon that is coated with thermally reflective deposition of metal. The head covering helps retain body heat, protect against sunburn, keep hair pulled away from a dive mask, restrains hair in the back of the head, and makes divers on the surface more visible to boat crew. The head covering has a tail compartment/pouch which can optionally be disguised so it substantially forms a hidden pocket. The fabric of the head covering is preferably brightly colored, stylish and decorative, and would be associated with a designer.

Figure 1:
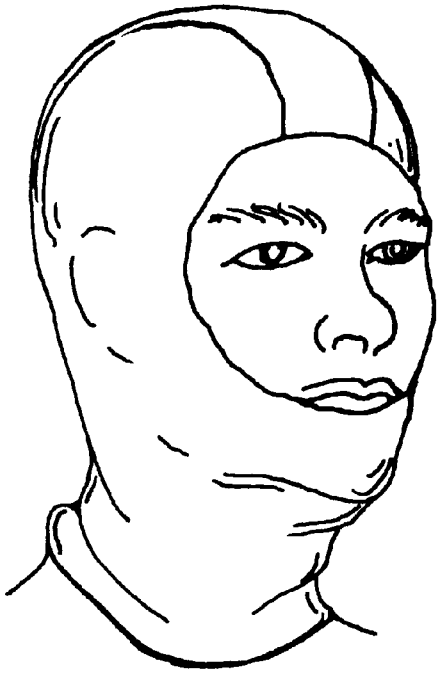
Fig.1 Prior Art
FIG. 1 is an illustration of the prior art which is the hood portion of a scuba diver suit.
Figure 2:
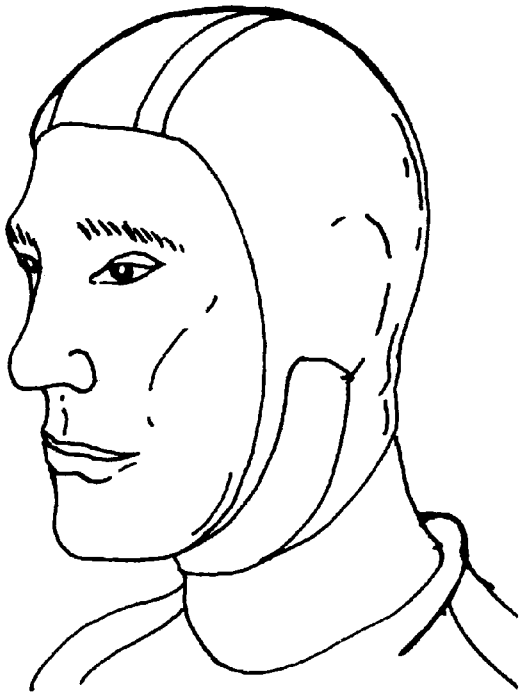
Fig.2 Prior Art
FIG. 2 is an illustration of the prior art which is a swimmer's cap, where the cap has a chin strap.
Figure 3:
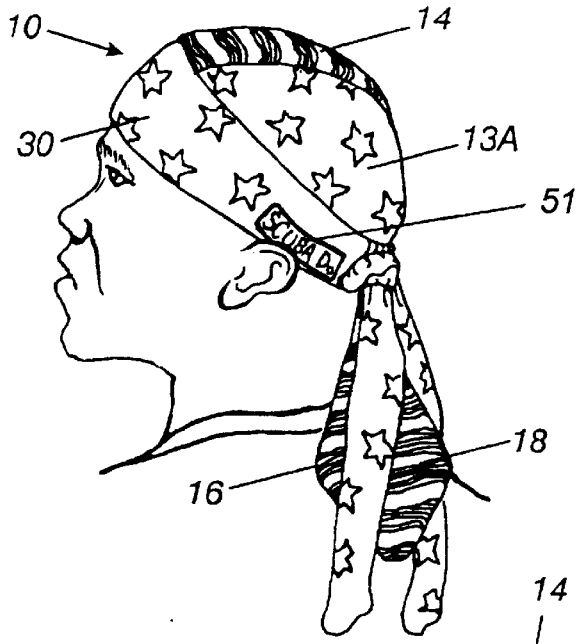
FIG. 3 is a perspective view of the invention as shown from the side, the central portion terminating in a tail portion having a triangular stingray shape, and the head covering being constructed of Spandex having a decorative design, the side of the edge band being shown having an identification (ID) label.
Figure 4:
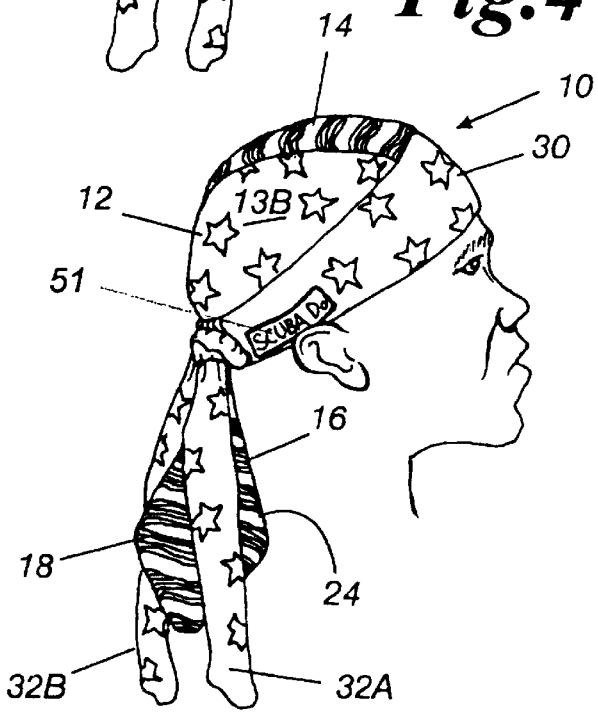
FIG. 4 is a perspective view of the invention shown in FIG. 3 as seen from the back right hand side of the wearer.
Figure 5:
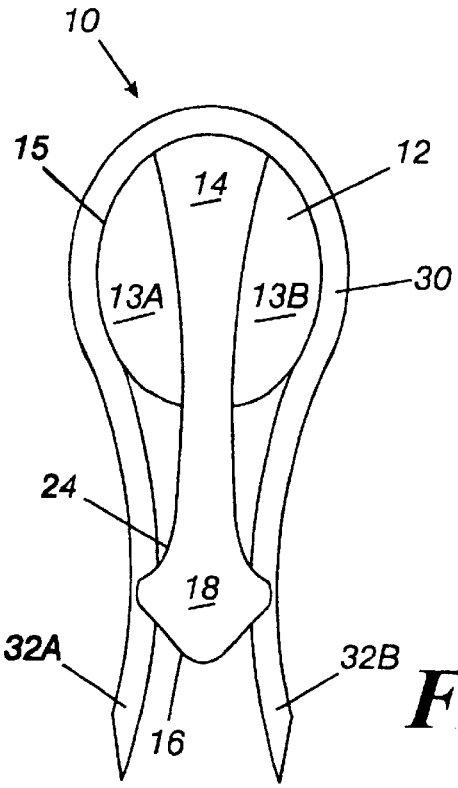
FIG. 5 is a top view of the invented head covering, wherein the band ends are shown untied.

A perspective side view of the head covering 10 is shown in FIG. 3, from the back right in FIG. 4, and from the top in FIG. 5. The band ends 32*a* and 32*b* are untied in FIG. 5. The head covering 10 is constructed of a central portion 12, which caps the head and an edge band 30, that substantially circumscribes the central portion and terminates in band ends 32*a* and 32*b*. The band serves to provide a retention means (i.e. ties, for retaining the head covering in place on the user's head).

The central portion 12 is preferably constructed of three pieces comprising a left panel 13*a* and a right panel 13*b* which flank a central piece 14. The assemblage of the left panel and the right panel and the central piece 14 forms the central portion 12.

The bridging central section 14 is preferably a part of an elongated panel, which is comprised of the central piece 14 and a tail portion 16, where the tail portion is defined by the region that extends beyond the perimeter edge 15. The tail portion 16 drapes down, and preferably forms a substantially trapezoidal flap 17 as shown in FIGS. 10, 11 and 12. Alternatively, the tail portion 16 necks down and then widens terminating in a blunt triangular, stingray tail section 18. The stingray tail section 18 embodiment is shown in FIGS. 3–9. In normal use, the tail portion 16 is long enough to provide protection from the sun, and depending on the design can drape down the user's back a substantial length.

Referring to FIGS. 4 and 5, the invented head covering 10 has a central portion 12 which is preferably three pieces 13A, 13B, and 14. The three pieces are cut and attached to form the covering central portion 12. The central portion 12 has a perimeter 15 which is substantially coextensive with the edge band 30.

The tail portion 16, as shown in FIG. 5 has a stingray shaped terminating tail section 18, which is preferably provided with a pouch 20 on its underside as shown in FIGS. 6–7. The pouch 20 may be open at the end 22 nearer the head, and it may be provided with a closure means such as velcro 24 in FIG. 6, or a zipper, buttons or snap(s) 26 in FIG. 7.

FIGS. 8 and 9 illustrate compartments that are particularly suited for securing and holding the wearer's hair. The wearer can combine their hair, for instance into a loose braid, and then push it down into the pouch on the underside of the tail portion. The band ends can be tied around the hair. In FIG. 8 the opening to the pouch is curved upward, making it easy to expand the opening by inserting a finger. In FIG. 9 the opening is substantially straight, and the opening is less restrictive, making it more suitable for housing hair in a tighter weave, such as a pony tail.

The central portion of the head covering 12, which is surrounded by an edge band 30 having band ends 32A and 32B which serve to provide retention means, i.e. ties, for retaining the head covering in place on the user's head. In use, the head covering is placed over the user's head, with the pouch against the user's neck. The band ends 32A and 32B are then tied above the pouch.

FIGS. 11 and 12 illustrate a tail portion 16 having a trapezoidal flap 17, where the base of the trapezoidal flap is hemmed. The hem can house a batten to give the trapezoidal flap 17 shape. Optionally, the trapezoidal flap can be fitted with a compartment. The underside of the flap is shown in FIG. 12. The flap has a pouch 20 and an entrance 22 to the pouch 20.

As shown in FIGS. 6 through 9 and FIGS. 11 and 12, the pouch can have various design elements, and can terminate in the tail portion 16, or at any desired location. A plastic liner can be provided within the pouch to hold various items and to protect them from moisture. Alternatively, a plastic bag can be placed within the pouch, therein providing a compartment that is water proof.

Figure 13:
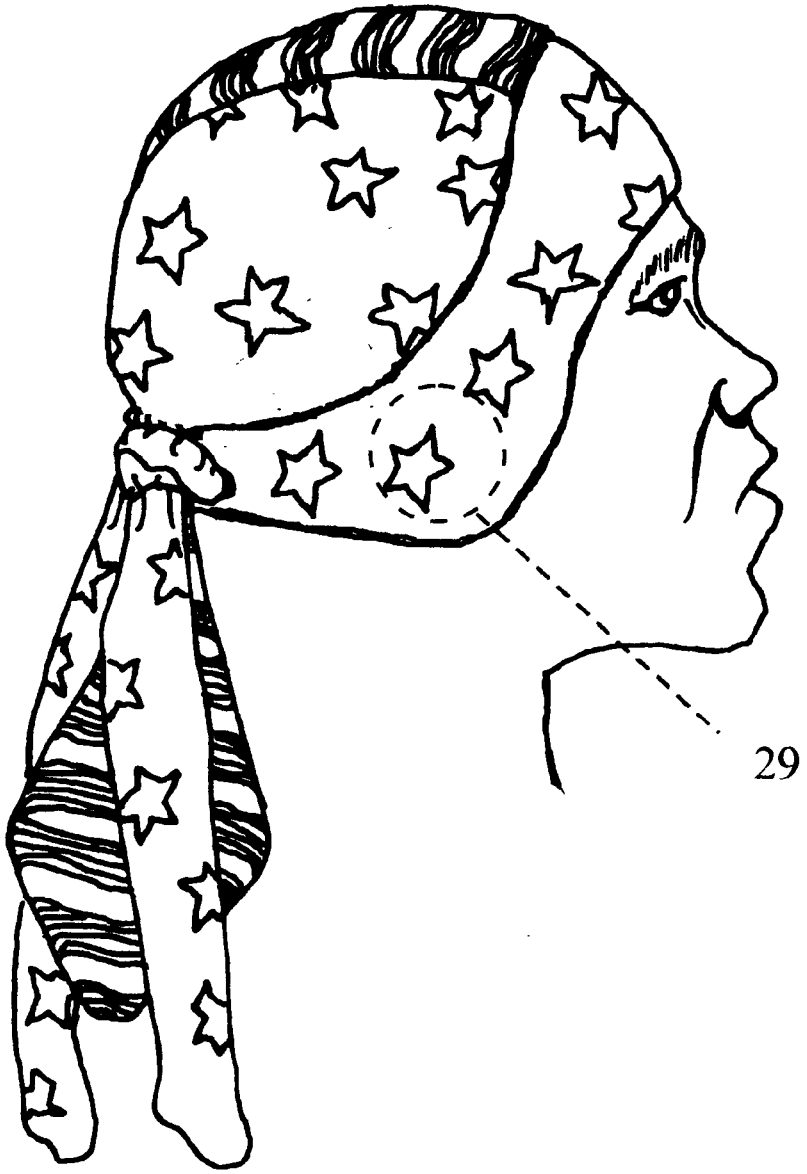
FIG. 13 is a perspective view of the invention as shown seen from the side, wherein the head covering is tied so that the wearer's ears are covered.

Referring to FIG. 13, the head covering 10 is adjusted so that the wearer's ears are covered. The region adjacent to the their ears is fitted with a side compartment 29, shown in ghost as a dashed line, which is fitted ear muffs constructed of an inner shell of ComforTemp fabric.

ALTERNATIVE EMBODIMENTS

The invention can be fitted with a moisture absorbent inner band 31, as shown in FIG. 10, where the inner band absorbs perspiration on the forehead. The moisture absorbent inner band is preferably filled with Hydrofil.

Alternatively the inner band 31 can be pre-wetted to help keep the user cool. The central portion is constructed of a wicking fabric, CoolMax, wherein the combination results in a static cooling tower.

The head covering 10 can be fitted with a label 51 as shown in FIG. 3. The label 51 can contain information such as the name of the wearer, endorsement information, advertisement information, the name of the owner of the head covering, etc. The label 51 is particularly useful as a means of identifying the wearer, especially when the user is a child.

SUMMARY OF THE ACHIEVEMENT OF THE OBJECTS OF THE INVENTION

From the foregoing, it is readily apparent that I have invented an improved head covering for athletic activities, particularly scuba diving, which is stretchable, quick drying and is readily repairable on a user's head, which has a level of retainment that is sufficient such that the head covering will not be dislodged either by water when diving into water, or by wind, which may have a compartment therein for storing small items or restraining the wearer's hair, which provides protection for a diver's head from direct contact with coral or debris, and which protects the wearer from the sun.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A head covering for a human participating in underwater activities comprising:

a central portion constructed to fit on the head of a wearer; said central portion having a perimeter edge and a tail portion which extends beyond the perimeter edge;

an edge band that is substantially coextensive and engaging with the perimeter edge, but not the tail portion, said edge band having left band end and a right band end, where the left band end and the right band end have sufficient length extending beyond the central portion to allow tying of the band ends for retaining the head covering on a user's head;

wherein said head covering is made from a stretchable fabric comprised of polyurethane, polypropylene, nylon, or a blend thereof.

2. The head covering according to claim 1, wherein the tail portion is provided with a compartment or pocket therein.

3. The head covering according to claim 2, wherein the compartment has an opening in the tail portion for securing the wearer's hair or small items.

4. The head covering according to claim 2, wherein the compartment is provided with a closure.

5. The head covering according to claim 4, where the closure is selected from the group consisting of hook and loop zipper, snap, and button.

6. A head covering according to claim 2, wherein said compartment in the tail portion is waterproof.

7. The head covering according to claim 1, where the head covering is made from a brightly colored fabric, whereby the user can be readily seen at a substantial distance.

8. The head covering according to claim 1, wherein the central portion is comprised of a left curved panel and a right curved panel which flanks an elongated center panel, where the elongated center panel extends beyond the perimeter edge forming the tail portion.

9. The head covering according to claim 1, wherein the tail portion has sufficient width to partially cover the user's neck, therein providing protection from sunburn.

10. The head covering according to claim 9, wherein the tail portion terminates in a blunt triangular shape.

11. The head covering according to claim 10, wherein the tail portion terminates in a shape that is similar to a stingray.

12. The head covering according to claim 9, wherein the tail portion terminates in a trapezoidal flap.

13. The head covering according to claim 1, wherein the edge band is fitted with a label for providing information about the user or the owner or other information.

14. The head covering according to claim 1, wherein said head covering is provided with at least one side compartment or pocket therein.

15. The head covering according to claim 1, wherein the stretchable fabric is comprised mostly of polypropylene.

16. The head covering according to claim 15, wherein the stretchable fabric is treated with an antimicrobial agent.

17. The head covering according to claim 1, wherein the stretchable fabric is comprised mostly of nylon.

18. The head covering according to claim 1, wherein the stretchable fabric is substantially comprised of nylon with a metallic deposition on one side.

19. A head covering for a human participating in underwater activities comprising:

a central portion constructed of panels to fit on the head of a wearer; said central portion having a perimeter edge and a tail portion which extends beyond the perimeter edge;

an edge band that is substantially coextensive and engaging with the perimeter edge, but not the tail portion, said band having a left band end and a right band end, where the left band end and the right band end have sufficient length extending beyond the central portion to allow tying of the band ends around the wearer's hair, therein pulling up the wearer's hair and retaining the head covering on a wearer's head;

wherein said head covering is made from a stretchable fabric comprised of polyurethane, polypropylene, nylon, or a blend thereof.

20. The head covering according to claim 19, which is made from a brightly colored fabric, whereby the user can be readily seen from a substantial distance.

21. The head covering according to claim 19, wherein the edge band is fitted with a moisture absorbent inner band that is in contact with the wearer's head.

22. The head covering according to claim 19, wherein the edge band is fitted with a label for providing information about the user or the owner or other information.

23. The head covering according to claim 19, wherein the stretchable fabric is comprised substantially of polyurethane.

24. The head covering according to claim 19, wherein the stretchable fabric wicks away water.

25. The head covering according to claim 19, wherein the stretchable fabric is treated with an antimicrobial agent.

26. The head covering according to claim 19, wherein the stretchable fabric is treated with a fire retardant.

* * * * *